United States Patent [19]

Ustin et al.

[11] Patent Number: 4,659,169

[45] Date of Patent: Apr. 21, 1987

[54] DEAD FRONT TERMINAL BLOCK ASSEMBLY

[75] Inventors: George Ustin, Croton-on-Hudson; Andrew P. Soltis, Yonkers, both of N.Y.

[73] Assignee: North American Philips Corporation, New York, N.Y.

[21] Appl. No.: 706,902

[22] Filed: Feb. 28, 1985

Related U.S. Application Data

[63] Continuation of Ser. No. 445,348, Nov. 29, 1982, abandoned.

[51] Int. Cl.[4] ..... H01R 13/514; H01R 9/24

[52] U.S. Cl. ..... 339/198 R; 339/210 M

[58] Field of Search ..... 339/198 R, 198 J, 205, 339/210 R, 210 M

[56] References Cited

U.S. PATENT DOCUMENTS

| | | | |
|---|---|---|---|
| 2,924,808 | 2/1960 | Hewes et al. | 339/210 M |
| 3,206,717 | 9/1965 | Brown et al. | 339/205 |
| 3,247,480 | 4/1966 | Orzechowski | 339/198 G |
| 3,539,977 | 11/1970 | Woertz | 339/198 R |
| 3,569,917 | 3/1971 | Vlijmen | 339/210 R |
| 3,654,587 | 4/1972 | McLaughlin | 339/210 R |
| 4,180,305 | 12/1979 | Ustin et al. | 339/198 H |
| 4,423,916 | 1/1984 | Muehlhausen, II | 339/206 R |

FOREIGN PATENT DOCUMENTS

| | | | |
|---|---|---|---|
| 660068 | 6/1965 | Belgium | 339/210 R |
| 1631850 | 12/1951 | Fed. Rep. of Germany . | |
| St6014 | 2/1956 | Fed. Rep. of Germany . | |
| 1035239 | 7/1958 | Fed. Rep. of Germany . | |
| 1275653 | 8/1968 | Fed. Rep. of Germany . | |
| 1297726 | 6/1969 | Fed. Rep. of Germany | 339/210 M |
| 2523164 | 12/1976 | Fed. Rep. of Germany | 339/198 R |
| 1147975 | 4/1969 | United Kingdom . | |

OTHER PUBLICATIONS

"Kulka" ad, Tele-Tech & Electronic Industries, p. 183, Mar. 1956.

*Primary Examiner*—Gil Weidenfeld
*Assistant Examiner*—Gary F. Paumen
*Attorney, Agent, or Firm*—Thomas A. Briody; William J. Streeter; Leroy Eason

[57] ABSTRACT

A terminal block assembly configured to prevent inadvertent contact with captivated electrical terminals while providing access to the terminals. The terminal block is formed from complementary insulating parts which collectively define permanently enclosed sections in which the terminals are disposed.

12 Claims, 6 Drawing Figures

PRIOR
ART

DEAD FRONT TERMINAL BLOCK ASSEMBLY

This is a continuation of application Ser. No. 445,348, filed Nov. 29, 1982, now abandoned.

BACKGROUND OF THE INVENTION

1. Field of the Invention

This invention relates to terminal block assemblies of the type including a plurality of electrically-isolated sections, each having a terminal located therein. In particular, the invention relates to terminal block assemblies having dead-front protection. With this type of protection the terminals located in the sections are at least partially covered, so that shock and short circuit hazards are minimized. Such protection is not only desirable but for certain applications is required under UL Standards in the United States and under VDE Standards in Western Europe.

2. Description of the Prior Art

Terminal blocks which provide dead front protection are described in U.S. Pat. No. 4,180,305, having the same applicants as the present application, and in U.S. Pat. No. 3,247,480. Each of these terminal blocks includes a cover which snaps over the top of barriers between adjacent terminals. The cover must be removed or pivoted away from the terminals, however, to gain access to the terminals, and dead-front protection must therefore be temporarily sacrificed. Protection will be lost if the cover is misplaced or intentionally removed.

A portion of a conventional dead-front terminal block assembly which provides constant protection is illustrated in FIG. 1. This terminal block assembly consists of a one-piece insulating molding 10 having a plurality of hollow sections 12, each containing a tubular clamp terminal 14. Each terminal comprises a tubular conductor 16, open at both ends, a pair of clamping screws 18 mounted in respective threaded holes formed in one side of the tubular conductor adjacent the open ends, and a clamping strap 20 passing through the tubular conductor near the side having the threaded holes. Each section 12 of the insulating molding 10 has openings 22 at opposite ends providing access to the opposite ends of the tubular conductor 16 located in the section, for enabling the insertion of wires or other conductive elements which are to be electrically-connected to each other by the tubular conductor. The insulating molding 10 also includes hollow extensions 24 for enclosing the heads of the clamping screws 18. The end of each hollow extension has an access opening 26 for inserting a screwdriver or test prod. The screws 18 in each tubular conductor 16 are turned, after insertion of wires (not shown) into opposite ends of the tubular conductor, forcing the ends of the respective clamping strap 20 against the wires to clamp them in place.

In dead-front terminal blocks such as that shown in FIG. 1, the openings for providing access to the tubular conductors and the openings for providing access to the screw heads are perpendicular to each other. Thus, complex molds having mutually perpendicular projections are needed to form the openings. Typically these molds comprise separable halves which together form a cavity for receiving molding material. The mutually perpendicular projections typically include fingers extending into the cavity from at least one half of the mold, toward the other half, and removable core pins inserted through side walls of the mold and extending into the cavity in a direction perpendicular to the fingers. Because of their complexity, such molds are both costly to produce and to operate.

Even with complex molds, dead-front terminal blocks cannot be produced which accept many of the terminal types commonly used with terminal blocks, such as right angle feed-through terminals. These types of terminals cannot be inserted through the small, limited-access openings provided in dead-front terminal blocks.

It is also difficult to assemble the tubular clamp terminals used with conventional dead-front terminal blocks, because the clamping screws cannot be screwed into the threaded holes of the terminals' tubular conductors until both the clamping screws and the tubular conductors are inserted into the hollow sections of the block through their respective access openings. After insertion, the ends of the screws must be aligned with the threaded holes, while both are hidden from view by the insulating block material. Removal of terminals found to be defective after assembly (such as those having damaged threads) is also difficult, because the hollow extensions enclosing the heads of the screws typically include means such as inwardly-extending projections for holding the screws captive after they are forcefully inserted past the projections.

In terminal blocks utilizing tubular clamp terminals it is desirable to have a wire stop in each section for preventing a wire or other conductor, inserted into one end of the terminal in the section, from passing more than halfway through the terminal's tubular conductor, and thus inhibiting insertion of a conductor into the opposite end. Typically such stops have been formed in either the tubular conductor itself or the clamping strap, thus complicating the structure of the terminal.

SUMMARY OF THE INVENTION

An object of the invention is to provide a dead-front terminal block which can be manufactured using simple molds which do not require removable core pins.

Another object of the invention is to provide a dead-front terminal block which accepts many of the terminal types commonly used with terminal blocks.

Yet another object of the invention is to provide a dead-front terminal block which simplifies assembly of the terminals used in the block.

Still another object of the invention is to provide a dead-front terminal block assembly having wire stops formed as an integral part of the block, thus simplifying manufacture of the terminals.

In accordance with the invention, a dead-front terminal block comprises complementary insulating parts which are individually molded and then, after the insertion of terminals, are joined together. The insulating parts include walls which cooperate to form enclosed sections for capturing the terminals when the parts are joined. One of these parts includes retaining means for securing the terminals in the sections, and another one forms receptacles for receiving the terminals. The assembled terminal block has openings allowing access to the terminals. Because the block is molded as separate parts, complex interiors and perpendicular openings can be formed by the use of relatively simple molds which do not require removable core pins.

In a preferred embodiment, inner walls of the assembled terminal block cooperate to form in each section at least one partition for dividing the section into outer subsections, each communicating with the openings for providing access to the terminal in the section. This partition includes an aperture which enables a conductive member, forming part of the terminal, to pass through the partition and extend into the outer subsections. The partition also serves as a wire stop, thus obviating the need for incorporating a stop in the terminal itself.

Many of the commonly used types of terminals can be utilized with the terminal block. The terminals are assembled prior to installation, and defective terminals can be replaced before the separate insulating parts of the block are joined.

One type of tubular clamp terminal usable with the terminal block includes a tubular member disposed in at least one of the outer subsections of the section in which the terminal is located. The portion of the terminal's conductive member extending into the subsection is surrounded by the tubular member. An external wire can be connected to the terminal by inserting it through the respective access opening in the terminal block and into the tubular member. The wire is then clamped between an inside surface of the tubular member and the conductive member extending into the tubular member. In a preferred embodiment a clamping screw is mounted in a threaded hole formed through one side of the tubular member, with one end of the screw resting against one side of the conductive member. By turning the screw, the tubular member is moved relative to the conductive member, enabling an inserted conductor to be clamped between these members.

When the above-described terminal having a tubular member in one outer subsection is used, the portion of the terminal located in the other subsection of the respective section can take various forms. For example it can be an identical tubular clamp or it can be in the form of a straight or a right angle feed-through member, where the conductive member continues through an opening in an outer wall of the terminal block, serving as a means for connecting another wire to the terminal.

Terminals not having tubular clamps can also be utilized in the terminal block. For example, a terminal can be formed solely from a conductive member having wire or other conductive element attachment means provided at one or both ends of the member. Such attachment means can be provided at an end, for example, by forming the end into one or more flat, blade-shaped terminations for accepting quick-connect connectors, or by providing a threaded hole and screw in the end for clamping a wire to the conductive member.

Preferably, the assembled insulating parts of the terminal block cooperate to form at least one recessed mounting hole between adjacent sections of the terminal block, thus providing short circuit protection with respect to terminal block mounting screws which commonly provide a conductive path to ground by virtue of the screw's physical contact with grounded chassis to which they attach the terminal block.

These mounting holes also define convenient locations for separating the terminal block into a plurality of terminal blocks. By connecting adjacent sections with a tubular wall which has the mounting hole formed therein, the terminal block can be separated at any hole location by cutting through the two opposite portions of the tubular wall common to the two adjacent sections.

The tubular walls can also be utilized to facilitate butt mounting of terminal blocks. By forming one-half of a tubular wall at the end of a terminal block, for engaging another one-half tubular wall at the end of another terminal block, the two blocks can be mounted end-to-end and the engaging tubular walls will establish a predetermined spacing between the adjacent sections of the two terminal blocks. Typically, this spacing will be identical to that between adjacent sections in an individual terminal block, so that abutting terminal blocks appear as one continuous terminal block with uniformly-spaced sections.

DESCRIPTION OF THE PREFERRED EMBODIMENTS

Figure 1:
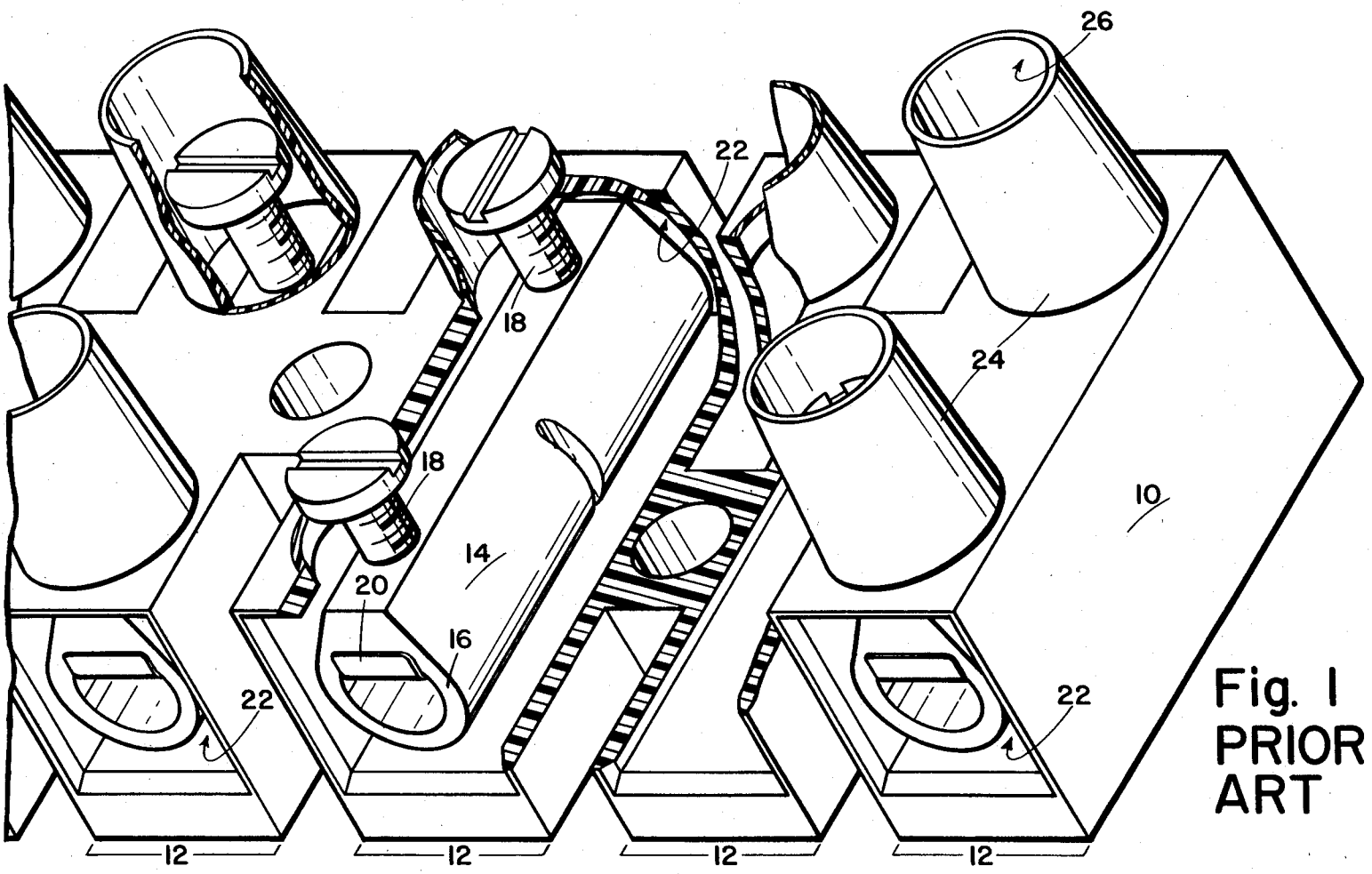
FIG. 1 is a perspective view of a segment of a prior art terminal block assembly, with a portion of the block cut away to show a terminal.
Figure 2:
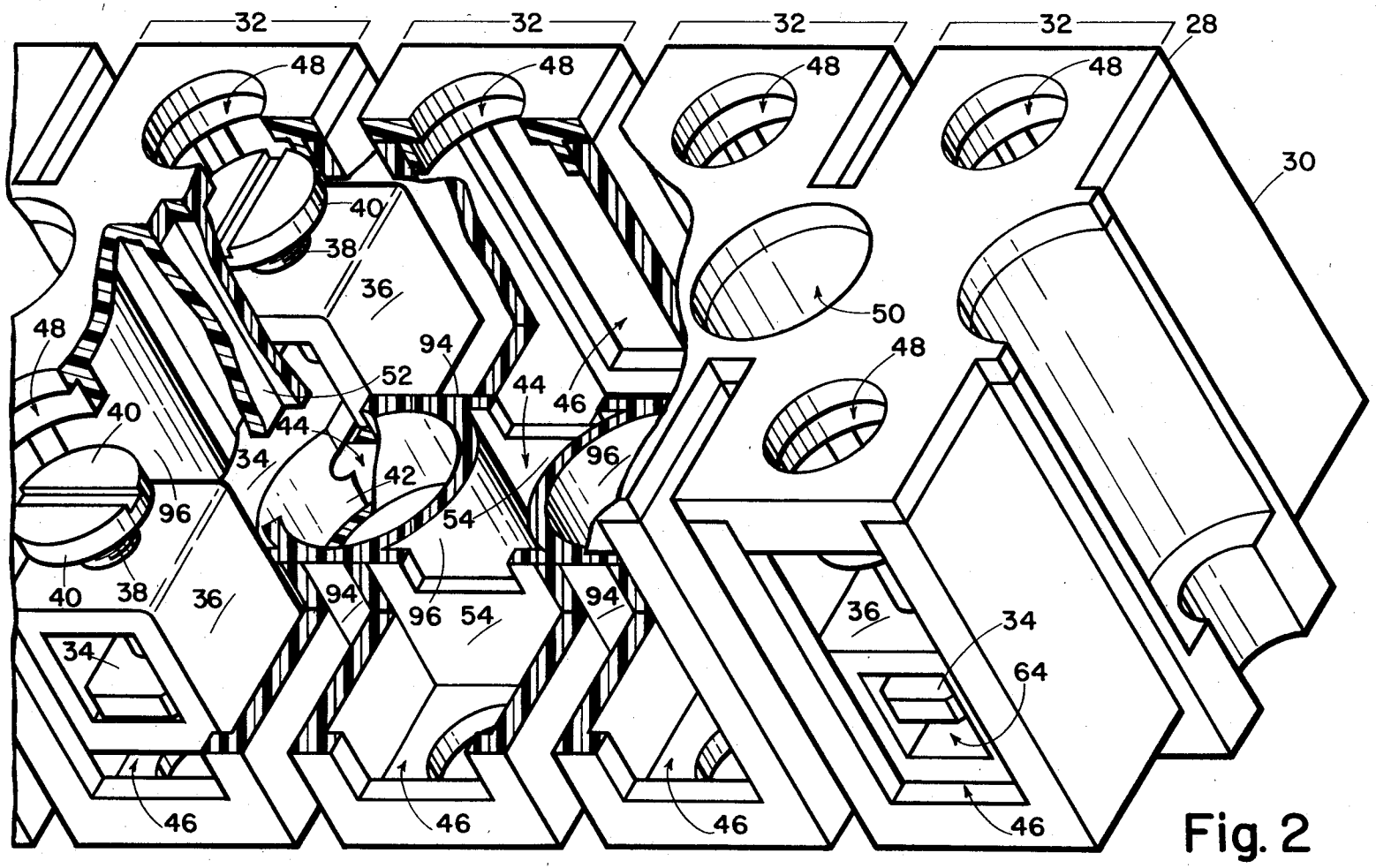
FIG. 2 is a comparable perspective view of a segment of a terminal block assembly in accordance with the invention.

FIG. 2 illustrates one form of a terminal block assembly constructed in accordance with the invention. This figure shows four sections at the right end of the terminal block assembly. The assembly can have as many sections as are desired. A portion of the assembly has been cut away and the terminals have been removed from two of the sections shown to reveal the inner structure of the assembled terminal block.

The terminal block assembly comprises individually molded first and second complementary insulating parts 28, 30, respectively, which have been ultrasonically welded together after the insertion of terminals. Alternatively, the parts can be held together by other means such as adhesive or interlocking latch members. The terminal block includes walls which cooperate to form enclosed sections 32 for capturing terminals such as the tubular clamping terminals shown. Each of these terminals includes a conductive member 34 and two identical tubular members 36, each having a threaded hole 38 in which a clamping screw 40 is inserted. The conductive member of each terminal extends into the tubular members and includes a flat surface against which the ends of the screws 40 rest. Each conductive member also includes a tab 42 which projects into a cavity 44 in a central subsection of the terminal block section enclosing the terminal. The tab and cavity cooperate to facilitate positioning of the conductive member in the terminal block. Each section includes openings 46 and 48 for providing access to the tubular members and the clamping screws, respectively, of the terminal in the section. The openings 46 and 48 are made smaller than the tubular members and the heads of the clamping screws, respectively, to captivate these elements in the terminal block.

Figure 3A:
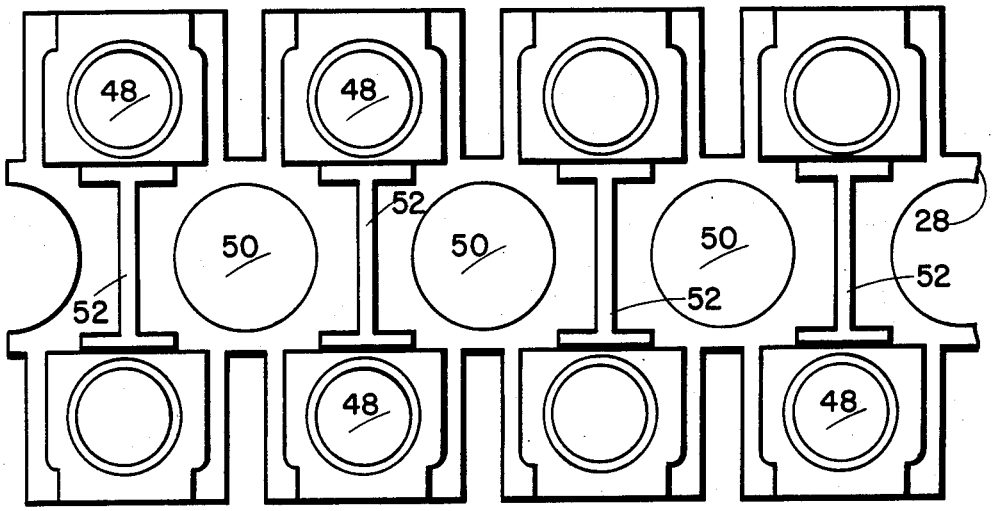
FIGS. 3*a*, 3*b*, 3*c* show various views of a segment of a terminal block assembly, including the inner side of a first part of the assembly, a front view of the assembly, and the inner side of a second part of the assembly having terminals inserted therein, respectively.
Figure 3B:
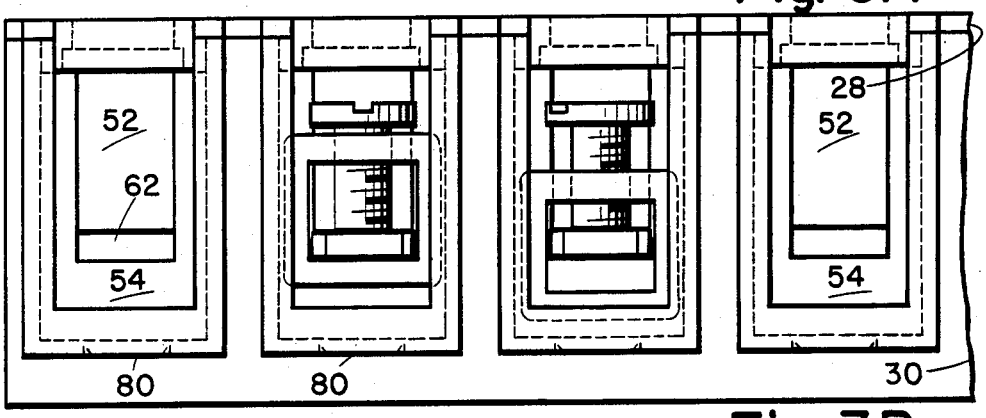
Figure 3C:
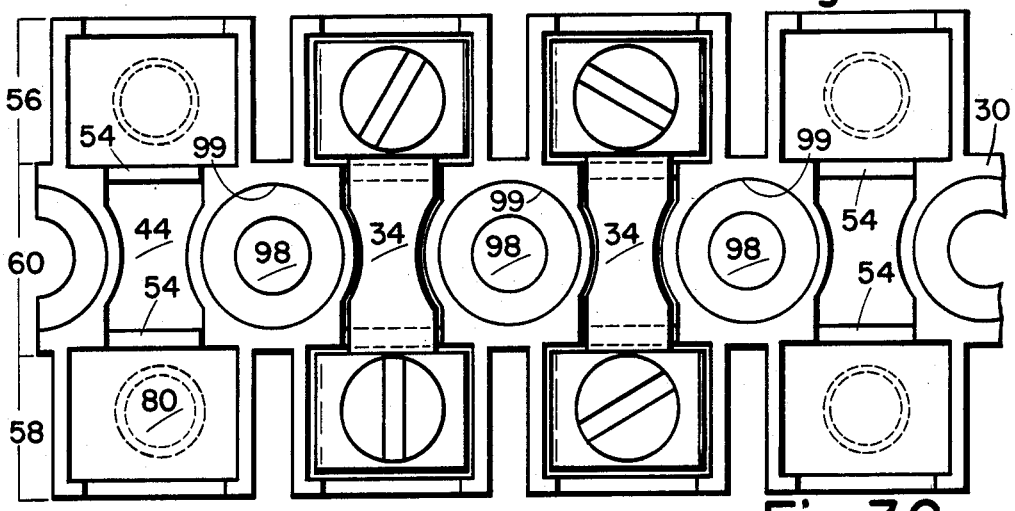

The interrelationships of the first insulating part, the second insulating part and the terminals can be better understood by also referring to FIGS. 3*a*, 3*b* and 3*c*, which illustrate different views of the left end of the terminal block assembly of FIG. 2, with terminals removed from two of the sections shown.

FIGS. 3*a* and 3*c* show the inner sides of the first and second insulating parts 28 and 30, respectively. In addition to the openings 48, the first insulating part 28 includes openings 50 for enabling insertion into the block of mounting screws (not shown). I-shaped inner walls 52 project from part 28 for holding the tabs of conductive members in the cavities of respective sections. The walls 52 also cooperate with inner walls 54 of the second insulating part to form two partitions in each section dividing the section into two outer subsections 56, 58 for containing the tubular members 36 and an inner subsection 60 in which the cavity 44 is located. As can be seen in FIG. 3*b*, which is a front view showing the first and second insulating parts assembled, an aperture 62 in each partition enables the conductive member 34 in each inserted terminal to pass through the partitions and extend through the entire section. The aperture in each partition is only large enough to pass the conductive member in the respective section and thus the partition serves as a wire stop for any conductor inserted into the tubular member in the adjacent outer subsection.

A conductor, such as a wire, is attached to one of the terminals by unscrewing the clamping screw 40 in one of the terminal's tubular members 36, allowing the tubular member to move down so that a gap 64 appears between the bottom of the conductive member 34 and the lower inside surface of the tubular member, as is shown in the far right section of the terminal block assembly illustrated in FIG. 2. (The conductive member will not move when the screw is rotated because this member is held in place by the partitions through which it passes.) The conductor to be attached is inserted into the gap and the screw is then turned into the tubular member causing the tubular member to move up until the conductor is clamped between the conductive member and the tubular member's lower inside surface.

Figure 4:
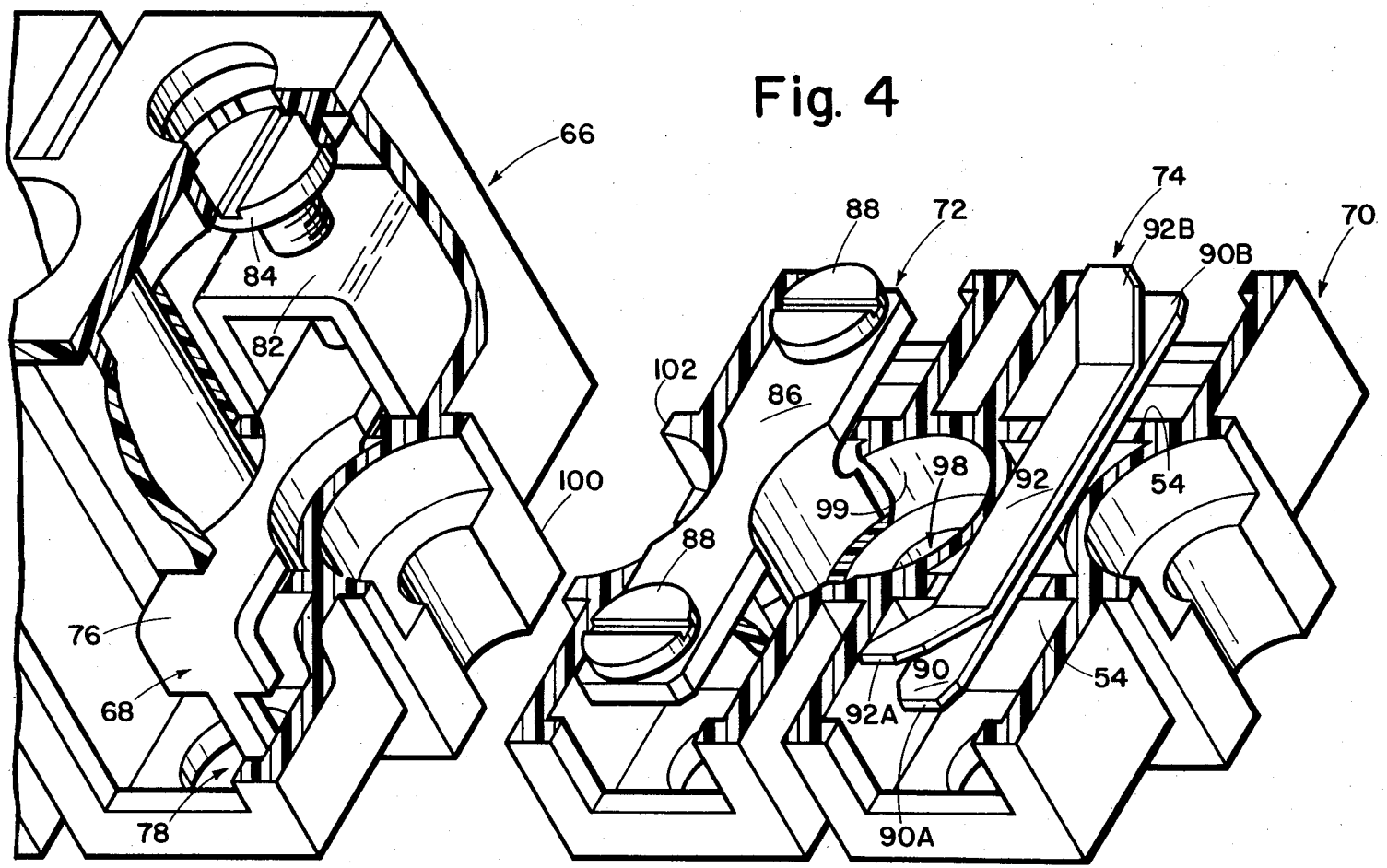
FIG. 4 is a perspective view illustrating the ends of two terminal block assemblies which are about to be brought together for butt mounting, showing a portion of each terminal block assembly cut away.

Although only tubular clamp terminals are shown in the above-described drawing figures, other types of terminals such as those shown in FIG. 4 can also be used. FIG. 4 illustrates the right end of a terminal block assembly 66 with a portion removed to reveal a right angle feed-through terminal 68, and a two section terminal block assembly 70 with the entire portion above the terminals removed to reveal a strap-clamp terminal 72 and a quick connect terminal 74.

The right angle feed-through terminal 68 comprises a conductive member 76 having one end bent at a right angle so that it extends through an opening 78 in the bottom of an outer subsection of the section in which the terminal is located. The opening can be permanently formed in the terminal block or it can be closed with a knock-out plug 80, as shown in FIGS. 3*b* and 3*c*, during molding. The illustrated square cross-section of the end of the conductive member 76 extending through the opening 78 is particularly suitable for wire-wrap or solder attachment of an external conductor. The opposite end of the conductive member 76 extends into a tubular member 82 in which a clamping screw 84 is operated as previously described for effecting clamping of a conductor inserted into the tubular member 82.

The strap-clamp terminal 72 comprises a conductive member 86 which is identical to the previously described conductive member 34, except for the inclusion of a clamping screw 88 in a threaded hole formed in each end. This type of terminal is particularly suitable for the attachment of spade lugs or bare-wire conductors between each screw 88 and the flat upper surface of the conductive member 86.

The quick connect terminal 74 comprises a conductive member 90 which is similar to the conductive member 34, but has an additional conductive member 92 welded thereto. Alternatively, member 92 could be attached by means of two mounting screws threaded into member 90, or by rivets, or the terminal could be formed from a one-piece folded conductive strip. The combined thickness of the members 90 and 92, at the location of the walls 54 must be no greater than the height of the apertures 62 (see FIG. 3*b*) in the partitions formed by the walls 52, 54. The opposite ends 90*a*, 90*b*, 92*a*, 92*b* of the conductive members 90, 92 are blade-shaped conventional quick-connect connectors (not shown). The ends 92*a*, 92*b* are bent at an angle with respect to the terminations 90*a*, 90*b* to provide clearance for attachment of the connectors.

As is best shown in FIG. 2, the adjacent sections 32 of the terminal block are attached to each other by means of tubular walls having portions 94 which actually connect adjacent sections of the terminal block and portions 96 which serve as side walls of the inner subsections of the sections. The portions 94 can be cut to subdivide the terminal block if smaller terminal blocks or fewer sections are desired.

As shown in FIGS. 3*c* and 4, the interior of each tubular wall is stepped so as to form a through hole 98 for a mounting screw and a counterbore 99 for the screw head. As shown in FIG. 4, each end of a terminal block assembly is preferably molded with half of such a tubular wall circumference. The opposite ends of each terminal block assembly are molded in this manner to facilitate end-to-end mounting of a plurality of terminal block assemblies. As can be clearly seen in FIG. 4, the one-half tubular walls 100, 102 form an additional mounting hole when the two terminal block assemblies shown are moved together, and serve to maintain the spacing between the adjacent end sections in the two terminal block assemblies equal to the spacing between adjacent sections in each individual terminal block assembly.

Although the above description has disclosed exemplary embodiments of the invention, various modifications can be made without departing from the scope of the invention. For example, more than two complementary insulating parts can be utilized to form the terminal block if desired. It is also possible to utilize types of terminals other than those described and to modify the structure of the terminal block to accommodate the terminals.

We claim:

1. A dead-front terminal block assembly comprising:

a plurality of terminals;

a terminal block including complementary insulating parts having walls which collectively define individually-enclosed sections containing respective ones of the terminals and having abutting walls which form partitions dividing respective ones of said individually-enclosed sections into first and second oppositely-disposed outer subsections;

each partition including an aperture defined by the abutting walls forming such partition, and each terminal including a conductive member which extends through the aperture in a respective one of said portions, to the associated outer subsections, such apertured partition serving to secure such conductive member in position;

each of said subsections of each section having an opening for receiving a conductor to be attached to the portion of the conductive member extending into such subsection, such conductor being prevented by said partition from extending into the other subsection of the section, at least one of said sections containing a terminal which includes a tubular member disposed in one of the outer subsections of such section, the conductive member in such section extending into such tubular member;

such tubular member including means for effecting clamping of a conductor to be inserted between the conductive member and an inside surface of the tubular member, such clamping means comprising a threaded hole formed through one side of the tubular member and a clamping screw inserted in the hole, said screw effecting movement of the tubular member relative to the conductive member when the screw is turned.

2. A dead-front terminal block assembly as in claim 1, where the partition-forming walls cooperate to form, in each section, two of said apertured partitions for dividing the respective sections into a central subsection and two outer subsections, said conductive member including a tab which projects into the central subsection for facilitating positioning of the conductive member in the section.

3. A dead-front terminal block assembly as in claim 1 where said terminal includes one of said tubular members disposed in each outer subsection of the respective sections.

4. A dead-front terminal block assembly as in claim 1 where said tubular member which is disposed in one outer subsection surrounds one end of the conductive member of the terminal in which such tubular member is included, and the other end of said conductive member extends through an opening in an outer wall of the terminal block facilitating connnection to a conductor external to the terminal block.

5. A dead-front terminal block assembly as in claim 4 where said other end of the conductive member extends through the opening at a right angle with respect to the direction of its extension in the tubular member.

6. A dead-front terminal block assembly as in claim 1 or 2 where at least one of said conductive members includes means, at the extension thereof into one of said outer subsections, for effecting attachment of a conductor to said conductive member.

7. A dead-front terminal block assembly as in claim 6 where the attachment means comprises a flat, blade-shaped end of the conductive member.

8. A dead-front terminal block assembly as in claim 6 where the attachment means comprises a threaded hole formed in the conductive member and a screw mounted in said hole.

9. A dead-front terminal block assembly as in claim 1 or 2 where the complementary insulating parts cooperate to form at least one recessed mounting hole between adjacent sections.

10. A dead-front terminal block assembly as in claim 9 where said mounting hole is formed by an opening in a first one of said parts and a tubular wall in a second one of said parts.

11. A dead-front terminal block assembly as in claim 10 where the tubular wall comprises portions which serve as portions of the walls of the adjacent sections and portions connecting the sections, said connecting portions serving as means at which the adjacent sections can be separated to subdivide the block into a plurality of blocks.

12. A dead-front terminal block assembly as in claim 11 where an end of the terminal block has formed therein one-half of one of said tubular walls for engaging another one-half tubular wall formed in the end of another terminal block, when the terminal blocks are mounted with ends abutting, said engaging tubular walls establishing predetermined distances between the adjacent sections of the two terminal blocks.

* * * * *